United States Patent [19]

Haddad

[11] Patent Number: 4,909,838

[45] Date of Patent: Mar. 20, 1990

[54] COATED MAGNESIUM GRANULES

[75] Inventor: Philip O. Haddad, Alvin, Tex.

[73] Assignee: The Dow Chemical Company, Midland, Mich.

[21] Appl. No.: 362,198

[22] Filed: Jun. 6, 1989

[51] Int. Cl.[4] ..... C21C 7/02

[52] U.S. Cl. ..... 75/58; 75/53

[58] Field of Search ..... 148/240; 75/58, 53

[56] References Cited

U.S. PATENT DOCUMENTS 3,957,502 5/1976 Cull ..... 75/58

4,040,818 8/1977 Clegg ..... 75/58

*Primary Examiner*—Peter D. Rosenberg

[57] ABSTRACT

A process for producing coated magnesium granules or powder having a protective surface layer selected from the group consisting essentially of magnesium fluoride, magnesium oxyfluoride and magnesium hydroxyfluoride by contacting magnesium particles with a fluoride-containing compound to form the layer of magnesium fluoride on the magnesium particles.

5 Claims, No Drawings

COATED MAGNESIUM GRANULES

BACKGROUND OF THE INVENTION

This Invention relates to a method of producing magnesium granules coated with a thin protective layer of fluoride, oxyfluoride or hydroxyfluoride.

Desulfurization of molten metal by magnesium is well known, for example, in the steel manufacturing process. Generally, magnesium is introduced into the molten hot metal by any of a variety of means, for example, a desulfurization agent may be added during steel manufacturing through injection lances. Upon injection, the magnesium melts, then vaporizes, and then the vapors dissolve into the molten hot metal. The dissolved magnesium reacts with sulfur present in the molten hot metal and forms magnesium sulfide, an insoluble compound. This insoluble compound has a density less than the density of molten hot metal and, thus, floats to the top of the molten metal and then mixes with the slag that is also floating on top of the liquid metal. The sulfur is removed by removal of the slag layer in a subsequent step.

It is also well known that magnesium when injected into steel causes a violent reaction, for example, when the addition of magnesium in particulate form, the violent reaction may take place in the form of bubbling, splattering, or the like. Also, finely ground particulate dust is difficult to meter in blast furnace injection processes and such finely ground dust injectables create a hazard in handling. For example, finely ground particulate when exposed to high temperature and oxygen may produce an explosion. Such may be the case with handling finely ground magnesium granules injected into a molten hot metal normally at process temperatures of up to about 1800 degrees centigrade.

Other known magnesium based injectable materials used as desulfurization agents include magnesium granules with a surface coating of a second material. For example, U.S. Pat. No. 4,331,711 discloses magnesium or alloys of magnesium particles coated with a salt such as a halide of Na, K, Li, Mg, Ca, Ba, Mn or Sr or mixtures of these salts.

U.S. Pat. No. 4,398,947 discloses a desulfurization agent including magnesium granules containing a coating of an anti-caking agent consisting of stearates of Mg, Ca and Al.

U.S. Pat. No. 4,401,465 discloses a desulfurization agent including substantially nonhygroscopic flux coated magnesium granules containing a coating of fluoride-containing salt such as alkali and alkaline earth metal fluorides and fluorborates.

Mixtures of powders of materials such as magnesium and calcium or lime are also known desulfurization agents. In addition, U.S. Pat. No. 4,705,561 discloses a composite material of a magnesium and calcium oxide useful as a desulfurization agent.

Another useful material as a desulfurization agent is disclosed in U.S. Pat. No. 4,708,737 which includes a magnesium impregnated with a magnesium alkaline earth metal compound and/or aluminum compound.

It is known to produce magnesium pellets by crushing and grinding magnesium ingots into various sizes and then screening the sizes to the desired size needed for a particular use.

For example, magnesium powder or granules are known to be used as a desulfurizing agent for a steel making process.

It would be desirable to provide a magnesium-based hot metal desulfurization reagent which is a single reagent. By "single reagent" it is meant that the reagent is not a mixture or composite material. A mixture can be, for example, a mixture of a magnesium and lime. It has been found that mixtures tend to separate into their individual components and, thus, there is an increased loss of metal with slag associated with the separation. The slag also creates a disposal or environmental problem. The production of a mixture increases the complexity of metering the appropriate proportions of blends of the components which is not always accurate or uniform.

It is also desirable to provide a magnesium based hot metal desulfurization reagent which is easy and safe to handle, has a low injection violence and has a high desulfurization efficiency.

It is desired to provide a magnesium-based powder or granule in solid or bulk form for use as a desulfurizing agent and possibly as a material which can be fed into extrusion presses or other forms of fabrication equipment without external remelt and its attendant losses. The granules may also be used as a material for alloying with other metals such as aluminum in conventional alloying processes. In addition, it is desired to produce a magnesium-coated desulfurizing agent which is safe to handle.

SUMMARY OF THE INVENTION

One aspect of the present invention is coated magnesium granules having a protective surface layer selected from the group of magnesium fluoride, magnesium oxyfluoride and magnesium hydroxyfluoride.

Another aspect of the present invention is a process for producing coated magnesium granules or powder comprising contacting magnesium particles with a fluoride-containing compound to form a layer of magnesium fluoride on the magnesium particles.

DETAILED DESCRIPTION OF THE PREFERRED EMBODIMENTS(S)

In accordance with the present invention a magnesium granule or powder is coated with a thin protective layer of fluoride, oxyfluoride or hydroxyfluoride. The protective coating on the magnesium granules or powder will make it possible for the safe handling of magnesium powder or granules in solid or bulk form for use as a desulfurizing agent and very possible as a material which can be fed into extrusion presses or other forms of fabrication equipment without external remelt and its attendant losses.

The thickness of coating on the magnesium granulate is generally from about 0.03 microns to about 0.5 microns and preferably from about 0.1 to about 0.3 microns.

The magnesium metal particles for use in the present invention may be obtained from various sources such as a magnesium melt as produced in electrolytic cells well known in the art or by known thermal processes for obtaining a 99.8% purity magnesium. The magnesium used in the present invention may also contain as alloyed ingredients, other metals such as aluminum, zinc, rare earth metals, manganese, Zr, Ag, Y, Th and the like. "Magnesium" herein means pure or various grades of magnesium melt or magnesium alloys, including, for example, AZ91, EZ33, ZK60, AM60, and other alloys listed in American Society for Testing and Materials (ASTM) B80-1987, page 34.

The fluoride-containing material which may be employed in the present invention may be selected from the group of fluorine, hydrogen fluoride, and sulfur hexafluoride. The amount of fluoride material present in the coating is generally from about 0.1 to about 10 and preferably, from about 1 to about 3 weight percent.

In carrying out one embodiment of the process of the present invention the following steps are followed in general:

Molten magnesium is pumped through a device for making small spherical particles such as a spinning disk, perforated spinning bucket, ultrasonic generator, and the like. The particles are formed in an inert atmosphere such as helium, argon, (or even hydrogen in the context of this process). This atmosphere contains sufficient HF, or $SF_6$, and $F_2$), as is necessary to react with and impart a protective coating on the granules. In passing through this atmosphere, the granules are cooled and solidified prior to striking a solid surface of the prilling chamber. The atmosphere is kept at a temperature of about 200 to about 800 degrees Fahrenheit by heat exchangers mounted within the vessel or externally to the prilling chamber. The level of fluoride containing reactants and water are monitored continuously, and maintained by addition of the required reactants. The solidified granules are collected in the bottom of the prilling chamber and removed through lock hoppers or similar means for removing the granules while maintaining the atmosphere in the prilling chamber.

EXAMPLE 1

In this example, magnesium pellets granules of about 40 mesh size were immersed in a 7 wt % HF aqueous solution and left for 24 hours. The granules were then rinsed with water and dried at about 70 degrees F.

To test the flowability of the pellets, a flame from a butane torch was pointed at and the flame tip contacted a small pile (about 8 grams) of the pellets. The pellets did not ignite after three minutes of exposure to the flame. The fluoride content in the pellets was about 2 wt %.

EXAMPLE 2

In this example, <20 mesh chipped magnesium was treated with 10 wt % HF as in Example 1. The treated magnesium chips did not sustain combustion after 180 seconds exposure to a flame. By comparison, untreated chips began sustained combustion after 15 seconds exposure to the flame. The treated magnesium chips contained about 1.0 wt. % fluoride.

EXAMPLE 3

Magnesium alloy, of AZ91B, in the form of chips, were treated in 10 wt. % HF for three days. The magnesium alloy chips had a bronze color and contained 0.7% fluoride. It was unexpectedly found that alloys with aluminum and zinc, such as AZ91B, could be treated without dissolving in the HF even with the aluminum and zinc contents.

What is claimed is:

1. A coated magnesium granule or powder comprising magnesium granules or powders having a protective surface layer selected from the group of magnesium fluoride, magnesium oxfluoride, and magnesium hydroxyfluoride.

2. The granule or powder of claim 1 wherein the surface layer is present on the granule in an amount ranging from about 0.2 to about 2.5 percent by weight of the coated granule.

3. A desulfurizing agent comprising magnesium granules or powders having a protective surface layer selected from the group of magnesium fluoride, magnesium oxfluoride and magnesium hydroxyfluoride.

4. A process for extruding a product comprising feeding a charge containing a magnesium granule or powder having a protective surface layer selected from the group of magnesium fluoride, magnesium oxyfluoride and magnesium hydroxyfluoride.

5. The granule of claim 1 wherein the fluoride content is present on the granule in an amount ranging from about 0.2 to about 2.5 percent by weight of the coated granule.

* * * * *